US006442793B1

(12) United States Patent
Paterson et al.

(10) Patent No.: US 6,442,793 B1
(45) Date of Patent: Sep. 3, 2002

(54) HANDLE AND EXHAUST DUCT COUPLING ASSEMBLIES FOR FLOOR CARE MACHINES

(75) Inventors: Chris M. Paterson; Dennis Lamb, both of Long Beach, MS (US); Melvin Teitzman, Boynton Beach, FL (US)

(73) Assignee: Oreck Holdings, LLC, Cheyenne, WY (US)

( * ) Notice: Subject to any disclaimer, the term of this patent is extended or adjusted under 35 U.S.C. 154(b) by 0 days.

(21) Appl. No.: 09/675,268

(22) Filed: Sep. 29, 2000

(51) Int. Cl.[7] ..... A47L 9/24

(52) U.S. Cl. ..... 15/410; 15/377; 285/7; 285/92

(58) Field of Search ..... 15/410, 377; 285/7, 285/34, 35, 92, 354

(56) References Cited

U.S. PATENT DOCUMENTS

| | | | | | |
|---|---|---|---|---|---|
| 2,941,822 | A | * | 6/1960 | Moecker | 285/7 |
| 3,073,626 | A | * | 1/1963 | Gasparini | 285/7 |
| 3,083,041 | A | * | 3/1963 | Owenmark | 285/7 |
| 4,006,512 | A | | 2/1977 | Saulson | 15/339 |
| 4,182,618 | A | | 1/1980 | Tschudy | 55/374 |
| 4,429,430 | A | | 2/1984 | Lyman | 15/182 |
| 4,566,884 | A | | 1/1986 | Jones et al. | 55/357 |
| 4,648,149 | A | | 3/1987 | Hampton et al. | 15/360 |
| 4,670,937 | A | | 6/1987 | Sumerau et al. | 15/329 |
| 4,733,430 | A | | 3/1988 | Westergren | 15/339 |
| 4,996,737 | A | | 3/1991 | Madru, Sr. | 15/366 |
| 5,031,266 | A | * | 7/1991 | Tillman et al. | 15/377 |
| 5,092,915 | A | | 3/1992 | Lackner | 55/375 |
| D333,023 | S | | 2/1993 | Herron, Jr. | D32/34 |
| 5,216,779 | A | | 6/1993 | Glenn, III | 15/351 |
| 5,367,741 | A | | 11/1994 | Hampton et al. | 15/323 |
| 5,390,392 | A | | 2/1995 | Thomas et al. | 15/339 |
| 5,440,782 | A | | 8/1995 | Yamashita | 15/398 |
| 5,462,311 | A | * | 10/1995 | Cipolla | 285/7 |
| 5,464,460 | A | | 11/1995 | Bosses | 55/374 |
| 5,544,385 | A | | 8/1996 | Jailor et al. | 15/350 |
| 5,560,108 | A | | 10/1996 | Wilson | 30/276 |
| 5,606,770 | A | | 3/1997 | Sovis et al. | 15/350 |
| 5,755,009 | A | | 5/1998 | Stephens et al. | 15/347 |
| 5,774,930 | A | | 7/1998 | Sommer et al. | 15/326 |
| 5,867,862 | A | | 2/1999 | Ahlf et al. | 15/329 |
| 5,896,618 | A | | 4/1999 | Woo et al. | 15/324 |

* cited by examiner

*Primary Examiner*—Theresa T. Snider
(74) *Attorney, Agent, or Firm*—Faegre & Benson LLP

(57) ABSTRACT

Handle and exhaust duct coupling assemblies for floor care machines are disclosed. In one embodiment, an exhaust duct coupling assembly includes a first duct having an outer surface with an external thread disposed thereon and a locking tab projecting outwardly therefrom. A second duct is slideably engaged into the first duct, and a flexible seal is disposed about the second duct proximate an end of the first duct. A collar having a hole therethrough is disposed about the second duct and threadedly engaged with the end of the first duct. The collar presses the seal into an approximately sealing engagement against the second duct and the end of the first duct. The collar includes a locking surface frictionally engaged with the locking tab and inhibiting a disengaging movement of the collar. Alternately, the locking surface of the duct coupling assembly may be an annular surface disposed on an inner surface of the collar, or may be disposed on an end surface of the collar. In yet another embodiment, a handle coupling assembly includes a receiving member having an outer surface with an external thread disposed thereon and a plurality of bendable members projecting outwardly therefrom and at least partially surrounding a receiving space. A handle tube is disposed within the receiving space. A collar is disposed about the handle tube and threadedly engaged with the external thread. The collar bends the plurality of bendable members into engagement against the handle tube, thereby securing the handle tube into position.

32 Claims, 11 Drawing Sheets

HANDLE AND EXHAUST DUCT COUPLING ASSEMBLIES FOR FLOOR CARE MACHINES

TECHNICAL FIELD

The present invention relates to handle and exhaust duct coupling assemblies for floor care machines, such as vacuums, extractors, steam cleaners, and the like.

BACKGROUND OF THE INVENTION

Many contemporary floor care machines are equipped with vacuum motors or other suction-generating apparatus for drawing particulates, fluids, or other materials from a floor surface and propelling such materials into a storage receptacle. Such floor care machines include upright and canister vacuums, extractors, steam cleaners, carpet shampooers, and other similar devices.

FIG. 1 is a side elevational, partially-exploded view of a floor care machine 20 (e.g. an upright vacuum) in accordance with the prior art. As is well known, the floor care machine 20 includes a head assembly 40 that engages a floor surface 22, and a dirt receptacle 26 for receiving and storing particulates. The head assembly 40 includes a vacuum unit 42 (not shown) that generates suction at the floor surface 22. An exhaust duct 28 extends upwardly from the head assembly 40. The exhaust duct 28 has a lower end 44 that is coupled to the vacuum unit 42 of the head assembly 40, and an upper end 46 that is coupled to a mid-handle connector 48 by a coupling assembly 50. The mid-handle connector 48 includes an exhaust outlet 29 that extends partially into the dirt receptacle 26. A handle support 30 is rigidly coupled to the mid-handle connector 48 by one or more fasteners 52 (e.g. screws, bolt, rivets, etc.). A handle grip 32 is attached to an upper end of the handle support 30.

In use, an operator grasps the handle grip 32 and actuates a control switch to transmit power to the vacuum unit 42. As will be understood by persons of ordinary skill in the art, the vacuum unit 42 creates suction within the suction compartment 60, drawing a particulate-laden airstream from the floor surface 12 through the intake aperture 64. The vacuum unit 42 propels the particulate-laden airstream through the head assembly 40, through the exhaust duct 28, through the mid-handle connector 48, and into the dirt receptacle 26, where the particulates may be filtered from the particulate-laden airstream and stored for later disposal. Floor care machines of the type shown in FIG. 1 are disclosed, for example, in U.S. Pat. No. 5,367,741 issued to Hampton et al, U.S. Pat. No. 5,230,121 issued to Blackman, U.S. Pat. No. 5,222,276 issued to Glenn, and U.S. Pat. No. 5,774,930 issued to Sommer et al.

FIG. 2 is an enlarged cross-sectional, assembled view of a coupling assembly 50 of the floor care machine 10 of FIG. 1. The coupling assembly 50 includes a collar 54 having an internal thread 56 and a partiallyconical sealing surface 58. A corresponding external thread 60 is disposed on the mid-handle connector 48. An "O"-ring seal 62 is positioned on the upper end 46 of the exhaust duct 28 between the collar 54 and the mid-handle connector 48. As the collar 54 is threadedly tightened onto the mid-handle connector 48, the sealing surface 58 presses the seal 62 into sealing engagement with the exhaust duct 28 and the mid-handle connector 48. Coupling assemblies 50 as shown in FIG. 2 are used, for example, in upright vacuum machines of the type generally disclosed, for example, in U.S. Pat. No. 6,033,451 issued to Fish et al.

Although desirable results have been achieved using such floor care machines, it may be desirable to further optimize the performance of these devices. For example, during use, the coupling assembly 50 is subjected to vibrational forces, torsional forces applied by the operator during pushing and pulling of the handle grip 32, and other loosening forces. After extended periods of use, the coupling assembly 50 may become loosened. As part of the maintenance of the machine, the operator may wish to check the collar 54 to prevent leakage from the exhaust duct 28. It may be advantageous, however, to reduce the operator's maintenance responsibilities.

SUMMARY OF THE INVENTION

The present invention is directed to handle and exhaust duct coupling assemblies for floor care machines, such as vacuums, extractors, steam cleaners, and the like. In one aspect, an exhaust duct coupling assembly includes a first duct having an outer surface with an external thread disposed thereon and a locking tab projecting outwardly therefrom. A second duct is slideably engaged into the first duct, and a flexible seal is disposed about the second duct proximate an end of the first duct. A collar having a hole therethrough is disposed about the second duct and threadedly engaged with the end of the first duct. The collar presses the seal into an approximately sealing engagement against the second duct and the end of the first duct. The collar includes a locking surface frictionally engaged with the locking tab and inhibiting a disengaging movement of the collar.

Alternately, the locking surface of the duct coupling assembly may be an annular surface disposed on an inner surface of the collar, or may be disposed on an end surface of the collar. In another aspect, the collar may include a second locking surface engaged with the locking tab.

In yet another aspect, a handle coupling assembly includes a receiving member having an outer surface with an external thread disposed thereon and a plurality of bendable members projecting outwardly therefrom and at least partially surrounding a receiving space. A handle tube is disposed within the receiving space. A collar is disposed about the handle tube and threadedly engaged with the external thread. The collar bends the plurality of bendable members into engagement against the handle tube, thereby securing the handle tube into position.

Alternately, at least some of the bendable members include a retaining ridge projecting inwardly toward the receiving space, and the handle tube has a retaining groove circumferentially disposed therein, the retaining ridges projecting into the retaining groove. In a further aspect, the receiving member includes a locking tab projecting outwardly from the outer surface, and the collar includes a locking surface frictionally engaged with the locking tab and inhibiting a disengaging movement of the collar.

DETAILED DESCRIPTION OF THE INVENTION

The present invention is generally directed to handle and exhaust duct coupling assemblies for floor care machines. Many specific details of certain embodiments of the invention are set forth in the following description and in FIGS. 3–11 to provide a thorough understanding of such embodiments. One skilled in the art will understand, however, that the present invention may have additional embodiments, or that the present invention may be practiced without several of the details described in the following description.

Figure 1:
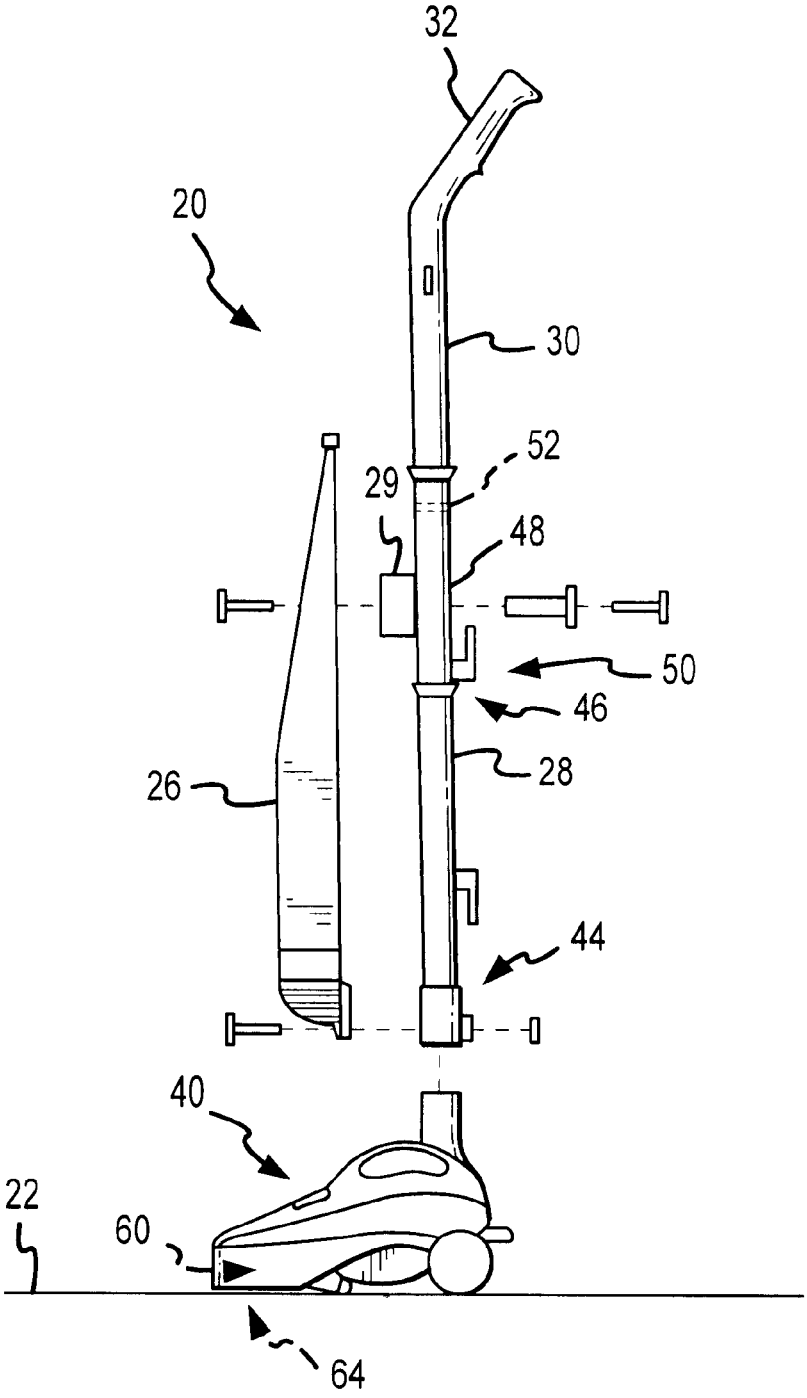
(PRIOR ART) FIG.1
FIG. 1 is a side elevational, partially-exploded view of a floor care machine in accordance with the prior art.
Figure 2:
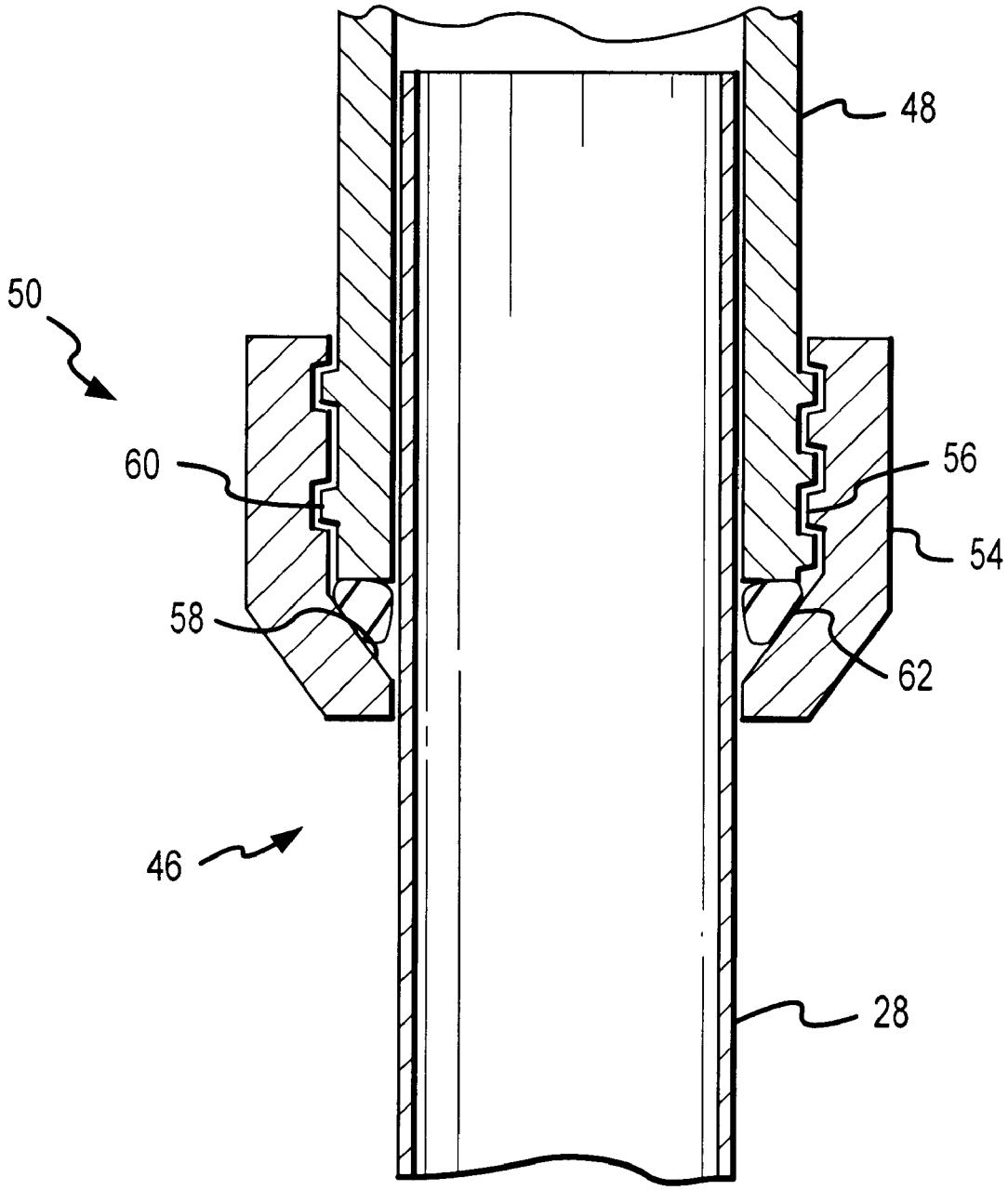
(PRIOR ART) FIG.2
FIG. 2 is an enlarged cross-sectional view of a coupling assembly of the floor care machine of FIG. 1.
Figure 3:
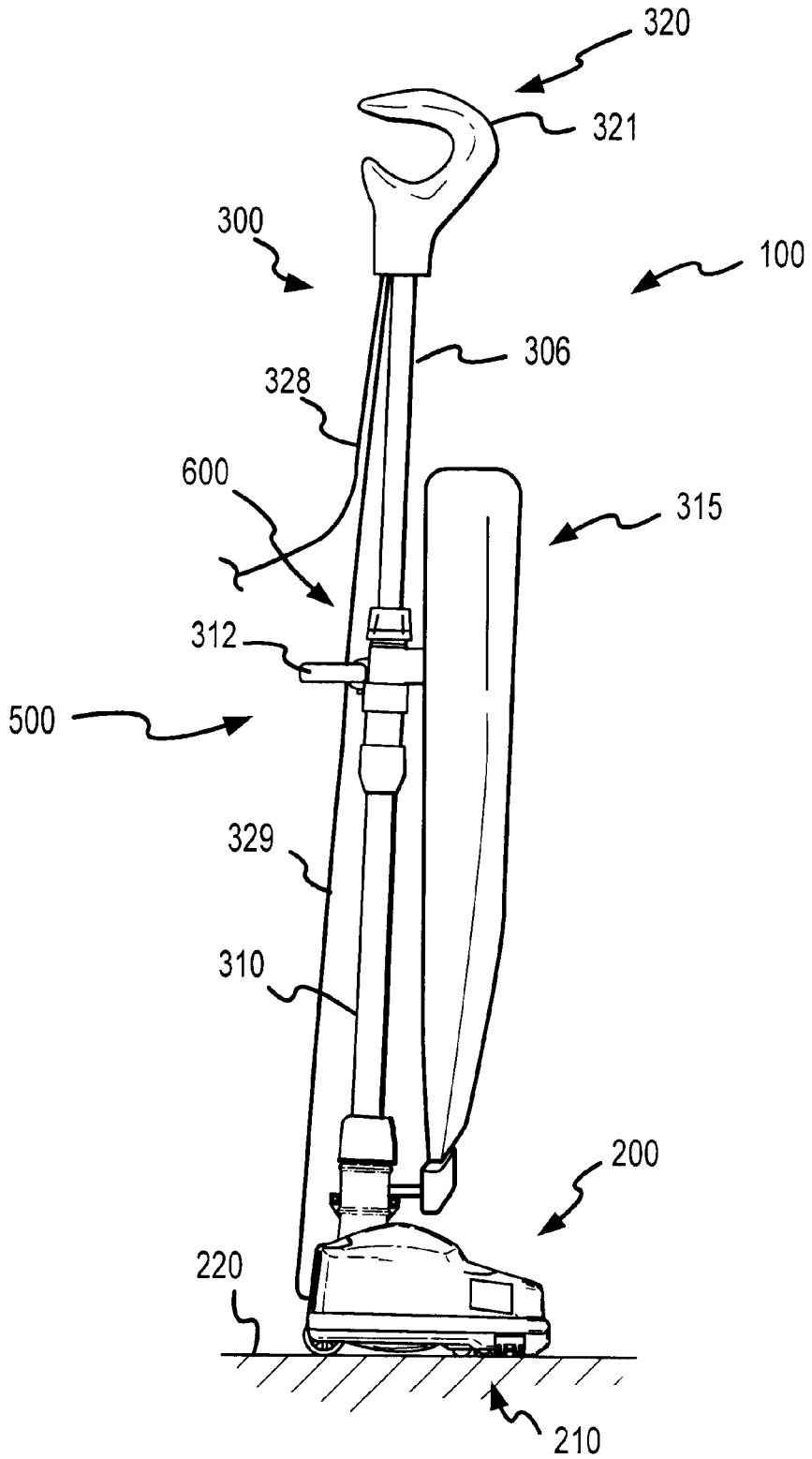
FIG. 3 is a side elevational view of a floor care apparatus in accordance with an embodiment of the invention.

FIG. 3 is a side elevational view of a floor care device 100 in accordance with an embodiment of the invention. In this embodiment, the floor care device 100 is an upright vacuum cleaner. The floor care device 100 includes a vacuum head 200 having an intake aperture 210 positioned close to a floor surface 220. A handle support 300 is pivotably coupled to the vacuum head 200 and extends upwardly from the vacuum head 200 to the handle assembly 320, enabling an operator to move the vacuum head 200 along the floor surface 220.

Figure 4:
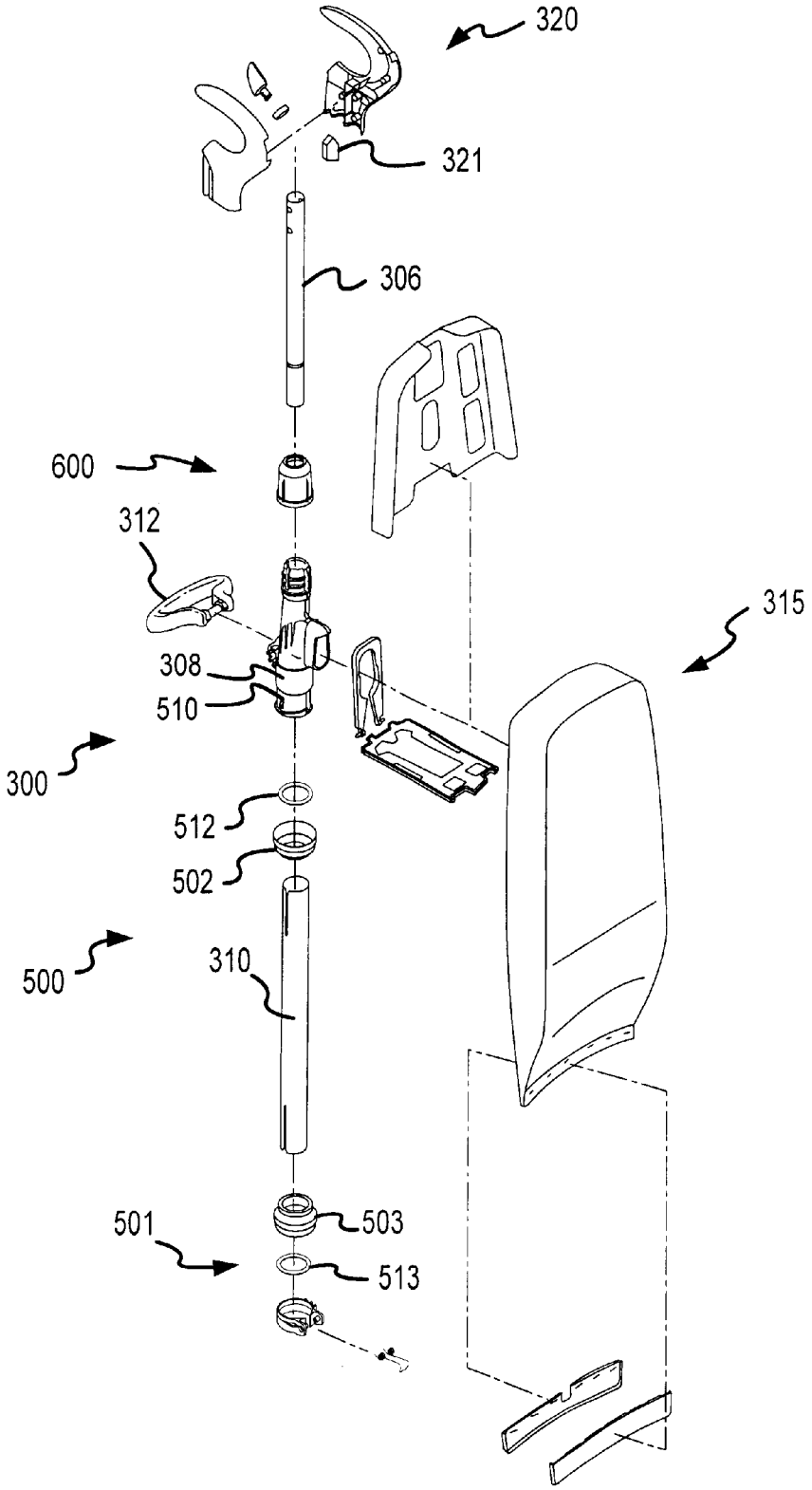
FIG. 4 is an exploded isometric view of an upper portion of the floor care apparatus of FIG. 3.

FIG. 4 is an exploded isometric view of an upper portion of the floor care device 100 of FIG. 3. As shown in FIG. 4, the handle support 300 includes an exhaust duct 310, a mid-handle connector 308, and a handle tube 306. The exhaust duct 310 is coupled to the mid-handle connector 308 by an exhaust duct coupling assembly 500. The mid-handle connector 308 receives a particulate-laden airflow exiting from the exhaust duct 310 and directs the airflow into an outer bag 315. The handle tube 306 is also coupled to the midhandle connector 308 by a handle coupling assembly 600. Novel aspects of the exhaust duct coupling assembly 500 and the handle coupling assembly 600 are described more fully below.

As shown in FIGS. 3 and 4, a secondary handle 312 may be attached to the mid-handle connector 308. The secondary handle 312 may be moveable between an extended position (see FIG. 3) and a folded position (not shown) adjacent the handle tube 306. As best shown in FIG. 3, a power cord 328 is attached to the handle assembly 320, and a control cord 329 extends between the handle assembly 320 and the vacuum head 200. A control switch 321 is disposed in the handle assembly 320. The control switch 321 is operatively coupled to the power cord 328 and to the control cord 329 to permit the operator to control the supply of power to the vacuum head 200.

Figure 5:
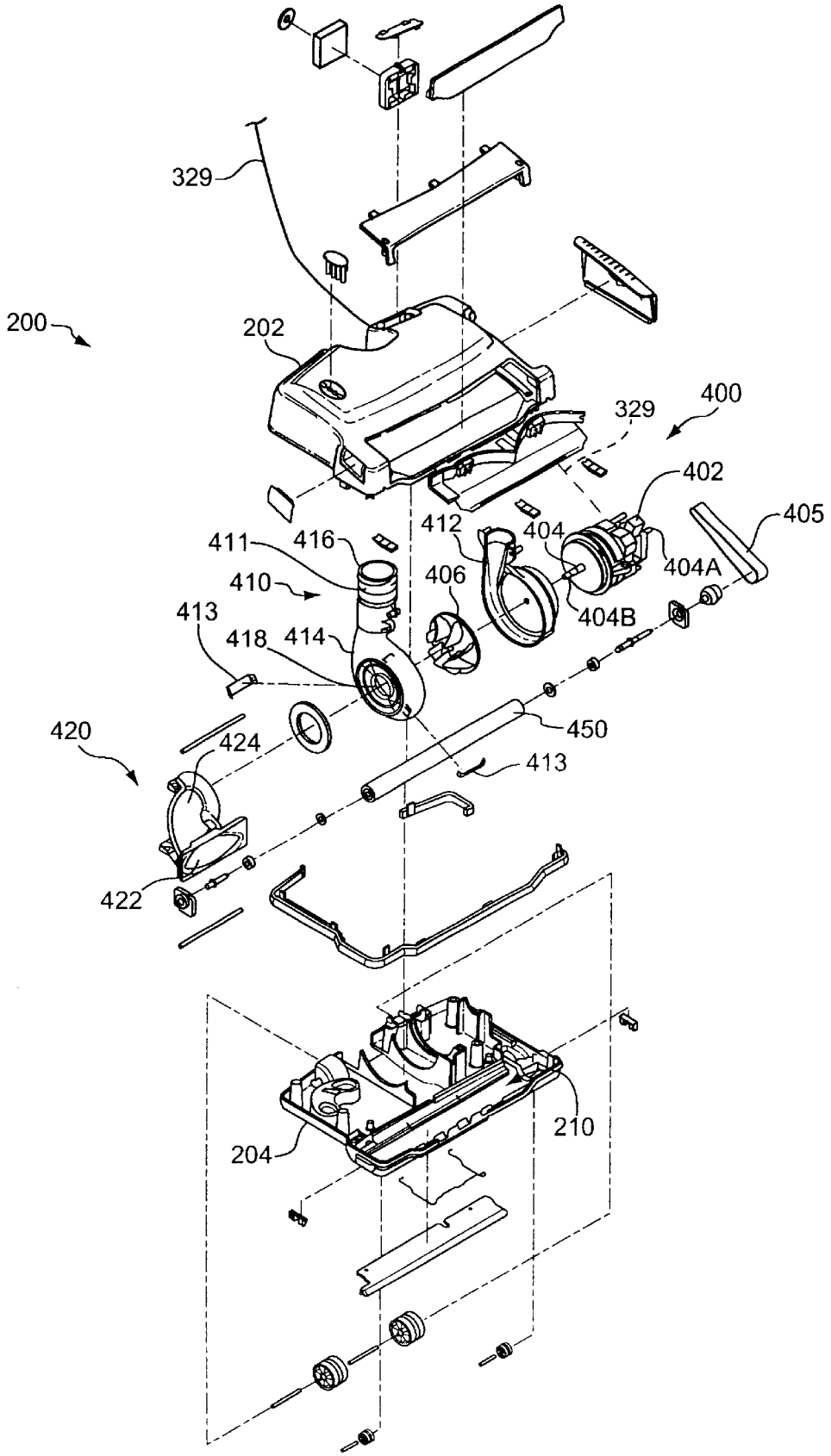
FIG. 5 is an exploded isometric view of a lower portion of the floor care apparatus of FIG. 3.

FIG. 5 is an exploded isometric view of a lower portion of the floor care device 100 of FIG. 3. As shown in FIG. 5, the vacuum head 200 includes an upper housing 202 and a bottom plate 204. An airflow propulsion device 400 is disposed within the vacuum head 200 between the upper housing 202 and the bottom plate 204. The airflow propulsion device 400 includes a motor 402 operatively coupled to the control cord 329 and having a drive shaft 404 that engages a belt 405 coupled between a first end 404A of the drive shaft 404 and a rotatable roller brush 450. As the motor 402 turns, the drive shaft 404 drives the roller brush 450 via the belt 405.

The airflow propulsion device 400 also includes a fan 406 coupled to a second end 404B of the drive shaft 404 and disposed within a fan housing 410. The fan housing 410 includes first and second halves 412, 414 held together by fasteners 413. A coupling portion 416 of the fan housing 410 is connected to the exhaust duct 310 of the handle support 300 (FIG. 4). The airflow propulsion device 400 further includes a suction duct 420 having a suction inlet 422 in fluid communication with the intake aperture 210, and a suction outlet 424 coupled to a central intake 418 of the fan housing 410.

In operation, an operator actuates the control switch 321 to transmit power supplied by the power cord 328 through the control cord 329 to the vacuum head 200. As will be understood by persons of ordinary skill in the art, the airflow propulsion device 400 creates suction at the intake aperture 210, drawing a particulate-laden airstream from the floor surface 220 through the intake aperture 210 and into the vacuum head 200. The airflow propulsion device 400 propels the particulate-laden airstream through the exhaust duct 310 of the handle support 300, through the mid-handle connector 308, and into the outer bag 315, where the particulates may be filtered from the particulate-laden airstream and stored for later disposal.

Figure 6:
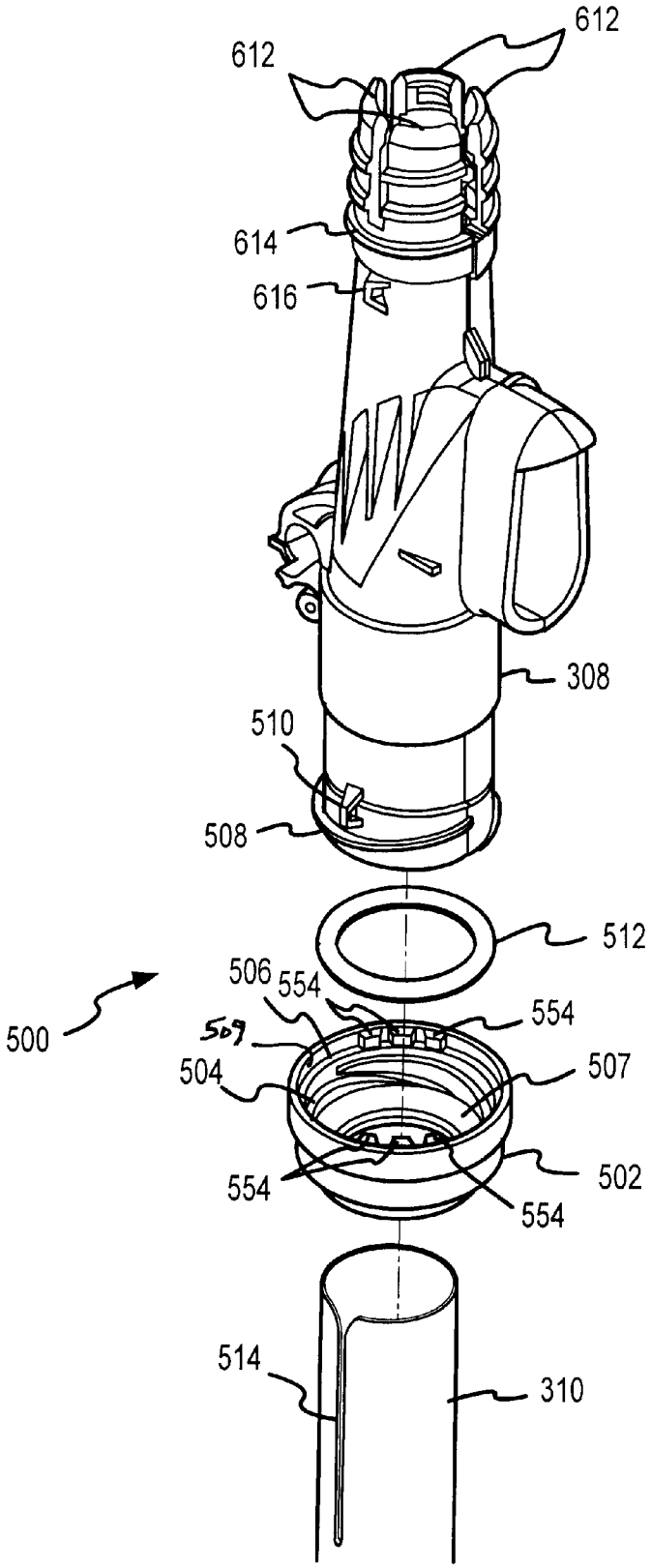
FIG. 6 is an isometric exploded view of an exhaust duct coupling assembly of the floor care apparatus of FIG. 3.
Figure 7:
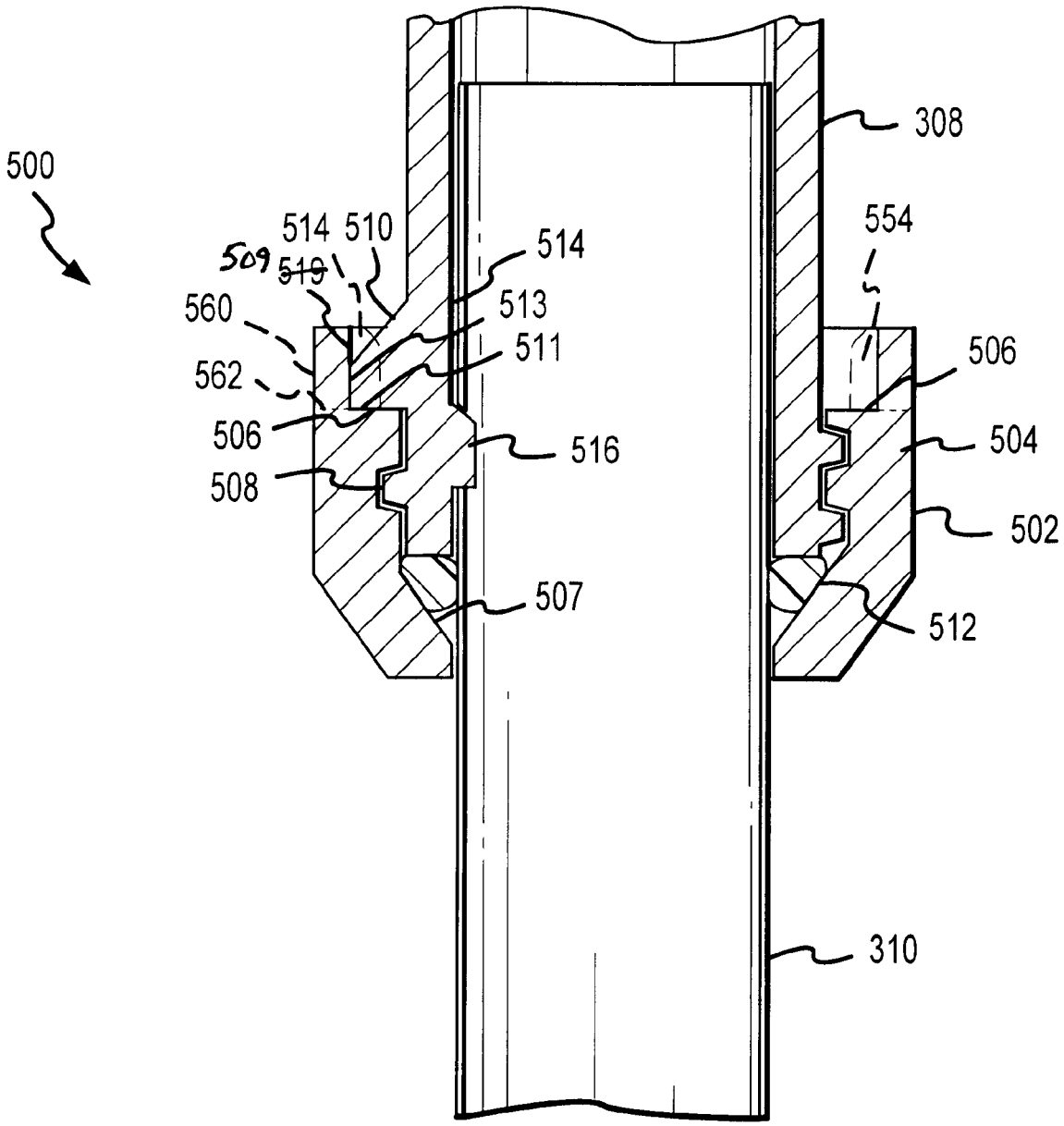
FIG. 7 is an enlarged cross-sectional, assembled view of the exhaust duct coupling assembly of FIG. 6.

FIG. 6 is an isometric exploded view of the exhaust duct coupling assembly 500 of the floor care apparatus 100 of FIG. 3. The exhaust duct coupling assembly 500 includes an exhaust collar 502 having an internal thread 504. A first locking seat (or surface) 506 is horizontally positioned adjacent the internal thread 504 proximate one end of the exhaust collar 502, and a sealing seat 507 is positioned proximate another end of the exhaust collar 502. A second locking seat 509 is disposed adjacent to the first locking seat 506. In this embodiment, the second locking seat 509 is perpendicular with the first locking seat 506. The mid-handle connector 308 includes an external thread 508 and a locking tab 510 projecting laterally outwardly from the mid-handle connector 308 proximate the external thread 508. The locking tab 510 includes a first locking face 511 and a second locking face 513 (FIG. 7). A compressible, elastomeric seal 512 (e.g. an "O" ring) is disposed between the exhaust collar 502 and the mid-handle connector 308.

FIG. 7 is an enlarged cross-sectional, assembled view of the exhaust duct coupling assembly 500 of FIG. 6. During assembly, the internal thread 504 of the exhaust collar 502 is threadedly engaged onto the external thread 508 of the mid-handle connector 308. As the exhaust collar 502 is threaded onto the mid-handle connector 308, the sealing seat 507 compresses the seal 512 into engagement with the mid-handle connector 308 and with the exhaust duct 310. The seal 512 deforms and squeezes radially inwardly against the exhaust duct 310, thereby forming an airtight seal about the exhaust duct 310 and holding the exhaust duct 310 in a fixed, non-sliding position relative to the mid-handle connector 308. As the exhaust collar 502 continues to be threadedly tightened onto the mid-handle connector 308, the first and second locking seats 506, 509 are moved upwardly until they engage against the first and second locking faces 511, 513 of the locking tab 510. The first and second locking faces 511, 513 frictionally engage the first and second locking seats 506, 509, respectively, inhibiting rotational movement of the exhaust collar 502.

As shown in FIG. 6, the exhaust duct 310 may also include an indexing slot 514 that may be engaged with an indexing tab 516 (FIG. 7) that projects inwardly from the mid-handle connector 308. As the end of the exhaust duct 310 is slid into the mid-handle connector 308, the indexing tab 516 may slide into the indexing slot 514, preventing the exhaust duct 310 from rotating with respect to the mid-handle connector 308. In alternate embodiments, the indexing slot 514 and the indexing tab 516 may be eliminated.

The exhaust duct coupling assembly 500 advantageously provides an airtight connection, preventing leakage of the particulate-laden airstream. Because the exhaust collar 502 squeezes the seal 512 into tight engagement with the exhaust duct 310, the exhaust duct 310 is held firmly in position in an airtight arrangement. Furthermore, the frictional engagement of the first and second locking faces 511, 513 with the first and second locking seats 506, 509 advantageously prevents the exhaust collar 502 from becoming accidentally loosened by vibration from the airflow propulsion device 400, torque from the operator pushing or pulling the handle assembly 320, or other loosening forces. Thus, the possibility of leakage occurring from the connection between the exhaust duct 310 and the mid-handle connector 308 is reduced. The maintenance requirements on the operator to regularly check and tighten the exhaust collar 502 are also reduced or eliminated.

Although the exhaust duct coupling assembly 500 is described and shown as being used to couple the exhaust duct 310 with the mid-handle connector 308, it should be understood that the coupling assembly 500 can also be used to couple the lower end of the exhaust duct 310 with the vacuum head 200. For example, as shown in FIGS. 4 and 5, a second exhaust duct coupling assembly 5601 may include a second exhaust collar 503 and a seal 513 threadedly engaged onto the coupling portion 416 of the fan housing 410, sealing the lower end of the exhaust duct 310 with the airflow propulsion device 400. A second locking tab 411 disposed on the fan housing 410 may engage a locking seat on the second exhaust collar 503, securing the second exhaust collar 503 into frictional engagement with the fan housing 410. Thus, the above-described advantages of exhaust duct coupling assemblies can be achieved at either end of the exhaust duct 310.

Figure 8:
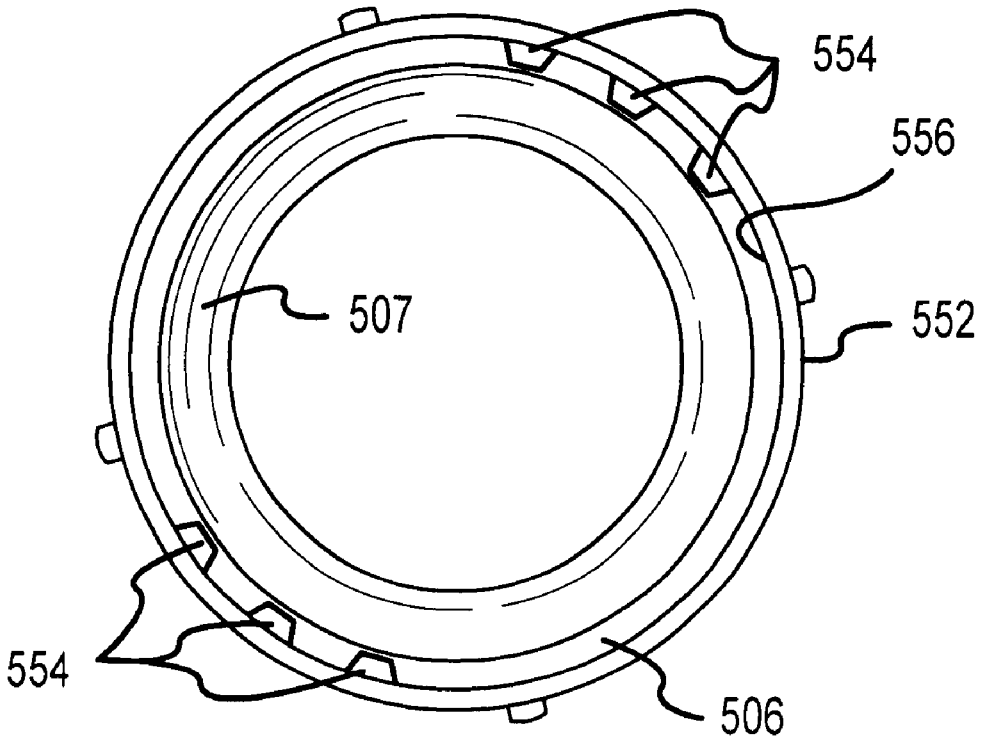
FIG. 8 is a top plan view of an exhaust collar in accordance with an alternate embodiment of the invention.

FIG. 8 is a top plan view of an exhaust collar 552 in accordance with an alternate embodiment of the invention. In this embodiment, the exhaust collar 552 includes a plurality of locking bumps (or ridges) 554 disposed about an internal peripheral edge 556 proximate the locking seat 506. The locking bumps 554, also shown in FIGS. 6 and 7, are sized to partially interfere with the locking tab 510 when the exhaust collar 552 is being threadedly engaged onto the mid-handle connector 308. As the exhaust collar 552 is being tightened onto the mid-handle connector 308, the locking bumps 554 may slide across the locking tab 510. When the exhaust collar 552 becomes securely tightened onto the midhandle connector 308, the locking bumps 554 are distributed such that the locking tab 510 may be positioned proximate one of the locking bumps 554. The locking bumps 554 may advantageously inhibit the exhaust collar 552 from being accidentally unthreaded from the mid-handle connector 502, such as may be caused by vibration or other loosening forces.

It should be understood that in alternate embodiments, the locking seat and the locking face need not be planar, as shown in FIGS. 6 and 7. Alternately, for embodiments having two (or more) locking seats, the locking seats (and corresponding locking faces) need not be perpendicular to each other, but rather, may be oriented at other non-orthogonal angles as desired. Furthermore, the exhaust collar 502 may have only a single locking seat, and the locking tab 510 may have only a single locking face. For example, in one alternate embodiment, an annular end portion 560 of the exhaust collar 502 may be removed by cutting along a parting plane 562, as shown in FIG. 7. With the annular end portion 560 removed, a single locking seat 506 would be formed on an end surface of the exhaust collar 502.

Figure 9:
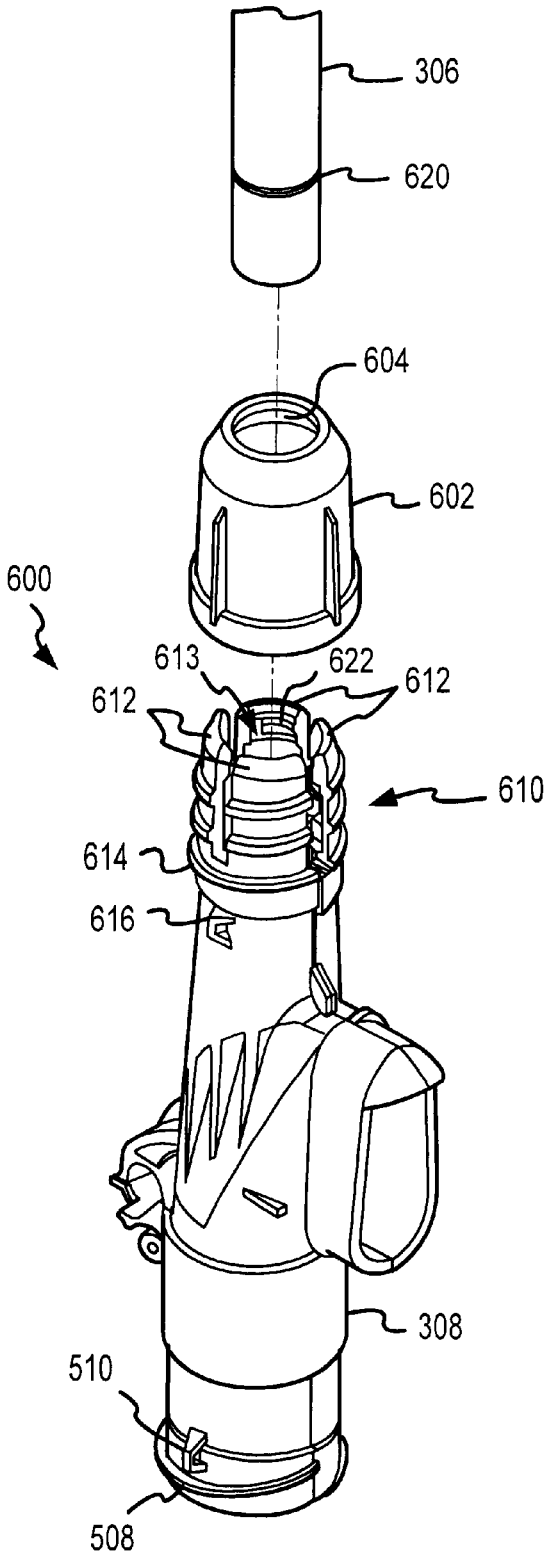
FIG. 9 is an isometric exploded view of a handle coupling assembly of the floor care apparatus of FIG. 3.

FIG. 9 is an isometric exploded view of a handle coupling assembly 600 of the floor care apparatus 100 of FIG. 3. The handle coupling coupling assembly 600 includes a handle collar 602 having an internal thread 604. The mid-handle connector 308 includes an engagement end 610 having a plurality of bendable members 612 projecting upwardly and partially surrounding a receiving space 613 therebetween. An external thread 614 is discontinuously disposed about the plurality of bendable members 612. A handle locking tab 616 projects laterally outwardly from the mid-handle connector 308 proximate the external thread 614.

Figure 10:
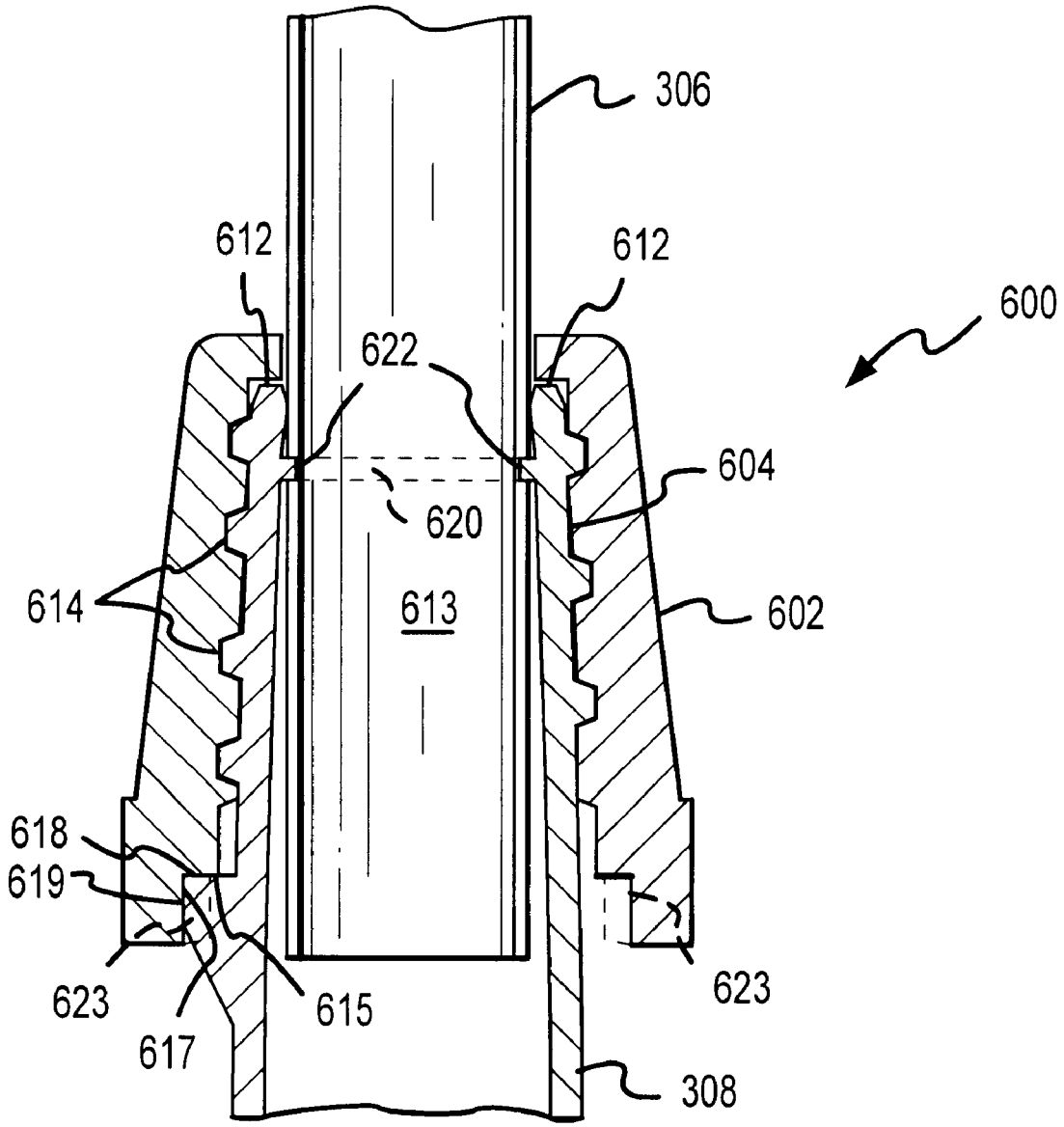
FIG. 10 is an enlarged cross-sectional, assembled view of the handle coupling assembly of FIG. 9.

FIG. 10 is an enlarged cross-sectional, assembled view of the handle coupling assembly 600 of FIG. 9. As shown in FIG. 10, the handle locking tab 616 includes first and second locking faces 615, 617. Similar to the duct coupling assembly 500 described above, the handle collar 602 includes first and second locking seats 618, 619 formed on an inner surface of the handle collar 602. The first and second locking seats 618, 619 frictionally engage the first and second locking faces 615, 617, respectively.

During assembly, the handle tube 306 is slideably engaged through the handle collar 602 and into the receiving space 613. As the handle collar 602 is threadedly engaged onto the engagement end 610, the handle collar 602 presses the bendable members 612 tightly against the handle tube 306, bending the plurality of bendable members 612 into engagement against the handle tube 306 and clamping the handle tube 306 into a fixed position. The handle collar 602 continues to be threaded onto the engagement end 610 until the first and second locking seats 618, 619 of the handle collar 602 engage against the first and second locking faces 615, 617 of the handle locking tab 616. The frictional engagement of the handle locking tab 616 against the locking seats 618, 619 inhibits the handle collar 602 from unintentionally unthreading from the engagement end 610.

As shown in FIGS. 9 and 10, a retaining groove 620 may be disposed around the circumference of the handle tube 306. Similarly, each of the bendable members 612 may include a retaining ridge 622 (FIG. 10) projecting inwardly toward the receiving space 613. During assembly, as the bendable members 612 are pressed into tight contact against the handle tube 306, the retaining ridges 622 may engage into the retaining groove 620, further locking the handle tube 306 into a fixed, non-sliding position relative to the mid-handle connector 308. Alternately, the retaining groove 620 and the retaining ridges 622 may be eliminated.

Referring again to FIG. 10, in an alternate embodiment, the handle collar 602 may further include one or more retaining members 623 that project outwardly from the second locking seat 619. Analogous to the locking bumps 554 described above, the retaining members 623 partially interfere with the second locking face 617 of the handle locking tab 616. During the final portion of the tightening as the handle collar 602 is threaded onto the mid-handle connector 308, the retaining members 623 slide across the handle locking tab 616. In a structure analogous that shown in FIGS. 6 through 8 and described above with respect to the exhaust duct coupling assembly 500, the retaining members 623 may be distributed on the second locking seat 619 such that at least one of the retaining members 623 may be proximate the handle locking tab 616 when the handle collar 602 is tightened onto the engagement end 610. The retaining members 623 may then interfere with the handle locking member 616, thereby inhibiting the handle collar 602 from accidentally becoming disengaged from (i.e. unthreaded from) the mid-handle connector 308.

As described above with respect to the collar 502 of FIGS. 6 and 7, it should be understood that the handle collar 602 may have a variety of alternate embodiments. For example, as shown in FIG. 6 with respect to collar 502, the handle collar 602 may have only a single locking seat (e.g. first locking seat 618) that engages with the handle locking tab 616. Alternately, the retaining members 623 may be disposed on the first locking seat 618, or on both the first and second locking seats 618, 619. Thus, the foregoing teachings of various embodiments that were shown and described above with respect to the collar 502 may also be applied to alternate embodiments of the handle collar 602.

Figure 11:
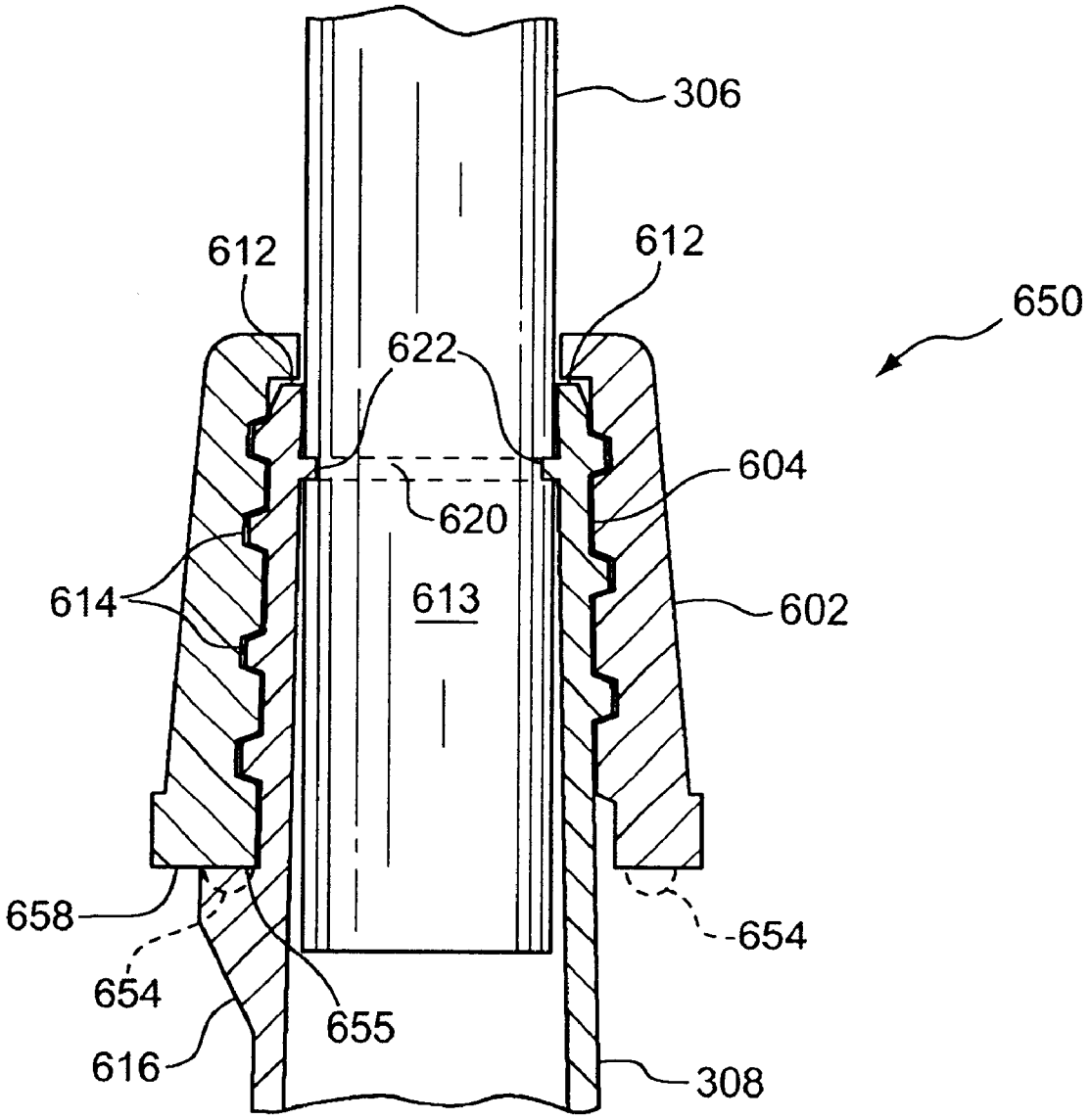
FIG. 11 is an enlarged cross-sectional, assembled view of a handle coupling assembly in accordance with an alternate embodiment of the invention.

FIG. 11 is an enlarged cross-sectional, assembled view of a handle coupling assembly 650 in accordance with an alternate embodiment of the invention. In this embodiment, the handle collar 602 includes an end surface 658 that frictionally engages a first locking face 655 of the handle locking tab 616. The handle coupling assembly 650 thereby provides the desired function of inhibiting decoupling of the handle collar 602 from the mid-handle connector 308 using a single locking interface.

In yet another embodiment, a plurality of locking bumps 654 may be disposed on the end surface 658, as shown in FIG. 11. In FIG. 11, the locking bumps 654 are partially-spherical (e.g. hemi-spherical) bumps. Like the retaining members 623 shown in FIG. 10, the locking bumps 654 may be distributed over the end surface 658 (similar to the locking bumps 554 shown in FIG. 8). The locking bumps 654 may partially interfere with the handle locking tab 616, thereby further inhibiting rotational movement of the handle collar 602 with respect to the mid-handle connector 308.

The handle coupling assemblies described above advantageously provide an easily assembled, easily disassembled, simple, cost-effective means of connecting the handle tube with the mid-handle connector. Another desirable feature is that the handle tube 306 may be slid into the receiving space 613 a variable distance, especially for embodiments in which the retaining groove 620 and retaining ridges 622 are eliminated. Thus, the height of the handle assembly 320 may be adjusted as desired by the operator. Furthermore, because the handle locking tab 616 frictionally engages one or more locking seats (or the end surface 658) of the handle collar 602, the handle collar 602 may be prevented from becoming unintentionally disengaged from the engagement end 610 due to vibration or other loosening forces.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other handle and exhaust duct coupling assemblies for floor care machines, and not just to the embodiments described above and shown in the accompanying figures. Accordingly, the scope of the invention should be determined from the following claims.

What is claimed is:

1. A duct coupling assembly for a floor care machine, comprising:

a first duct having a first passage and a first engagement end including an outer surface having an external thread disposed thereon and a locking tab projecting outwardly from the outer surface;

a second duct having a second engagement end slideably engaged into the first passage and including a second passage in fluid communication with the first passage;

a flexible seal disposed about the second duct and being positioned proximate the first engagement end of the first duct; and a collar having a hole therethrough, the second duct projecting through the hole, the collar at least partially surrounding the seal and the first engagement end of the first duct, the collar including an internal thread threadedly engaged with the external thread, and a sealing surface proximate the internal thread and at least partially engaged against the seal and pressing the seal into an approximately sealing engagement against the second duct and the first engagement end of the first duct, the collar further including a locking surface frictionally engaged with the locking tab and inhibiting a disengaging movement of the collar.

2. The coupling assembly of claim 1 wherein the locking surface comprises an annular surface disposed on an internal surface therefor.

3. The coupling assembly of claim 1 wherein the locking surface comprises an annular surface disposed on an internal surface proximate the internal thread opposite from the sealing surface, the locking tab being at least partially engaged within the hole.

4. The coupling assembly of claim 1 wherein the locking surface comprises an annular surface disposed on an end surface of the collar.

5. The coupling assembly of claim 1 wherein the locking surface comprises a first locking surface, the collar further comprising a second locking surface frictionally engaged with the locking tab.

6. The coupling assembly of claim 5 wherein the second locking surface is adjacent the first locking surface.

7. The coupling assembly of claim 5 wherein the second locking surface is approximately perpendicular to the first locking surface.

8. The coupling assembly of claim 1 wherein the collar includes at least one locking bump disposed on the locking surface proximate the locking tab and inhibiting a disengaging movement of the collar.

9. The coupling assembly of claim 1 wherein the second duct includes an indexing slot longitudinally disposed in the second engagement end and the first duct includes an indexing tab projecting into the indexing slot.

10. A handle coupling assembly for a floor care machine, comprising:

a receiving member having an outer surface with an external thread disposed thereon and a plurality of bendable members projecting outwardly therefrom and at least partially surrounding a receiving space, and wherein at least some of the plurality of bendable members include a retaining ridge projecting toward the receiving space;

a handle tube having an engagement end disposed within the receiving space and a retaining groove circumferentially disposed therein, the retaining ridges projecting into the retaining groove; and a collar having a hole therethrough, the handle tube projecting through the hole, the collar at least partially surrounding the plurality of bendable members, the collar having an internal surface including an internal thread threadedly engaged with the external thread and bending the plurality of bendable members into engagement against the engagement end of the handle tube.

11. The handle coupling assembly according to claim 10 wherein the receiving member includes a locking tab projecting outwardly from the outer surface, and the collar includes a locking surface frictionally engaged with the locking tab and inhibiting a disengaging movement of the collar.

12. The handle coupling assembly of claim 11 wherein the locking surface comprises an annular surface disposed on an end surface of the collar.

13. The handle coupling assembly of claim 11 wherein the locking surface comprises a first locking surface, the collar further comprising a second locking surface frictionally engaged with the locking tab.

14. The handle coupling assembly of claim 13 wherein the second locking surface is adjacent the first locking surface.

15. The handle coupling assembly of claim 11 wherein the collar includes at least one locking bump disposed on the locking surface proximate the locking tab and inhibiting a disengaging movement of the collar.

16. A floor care machine, comprising:

a head assembly having an airflow propulsion device including a motor having a drive shaft, a fan operatively coupled to the drive shaft, and a fan housing disposed about the fan;

a handle assembly including a mid-handle duct having a first passage and a first engagement end including an outer surface having an external thread disposed thereon and a locking tab projecting outwardly from the outer surface;

an exhaust duct coupled to the fan housing and having a second engagement end slideably engaged into the first passage and including a second passage in fluid communication with the first passage;

a flexible seal disposed about the exhaust duct and being positioned proximate the first engagement end of the mid-handle duct; and a collar having a hole therethrough, the exhaust duct projecting through the hole, the collar at least partially surrounding the seal and the first engagement end of the mid-handle duct, the collar including an internal thread threadedly engaged with the external thread, and a sealing surface proximate the internal thread and at least partially engaged against the seal and pressing the seal into an approximately sealing engagement against the exhaust duct and the first engagement end of the mid-handle duct, the collar further including a locking surface frictionally engaged with the locking tab and inhibiting a disengaging movement of the collar.

17. The floor care machine of claim 16 wherein the locking surface comprises an annular surface disposed on an internal surface therefor.

18. The floor care machine of claim 16 wherein the locking surface comprises an annular surface disposed on an end surface of the collar.

19. The floor care machine of claim 16 wherein the collar includes at least one locking bump disposed on the locking surface proximate the locking tab and inhibiting a disengaging movement of the collar.

20. The floor care machine of claim 16 wherein the exhaust duct includes an indexing slot longitudinally disposed in the second engagement end and the mid-handle duct includes an indexing tab projecting into the indexing slot.

21. A floor care machine, comprising:

a head assembly having an airflow propulsion device including a motor having a drive shaft, a fan operatively coupled to the drive shaft, and a fan housing disposed about the fan;

a handle assembly including an exhaust duct coupled to the fan housing and to a mid-handle member, the mid-handle member having an outer surface with an external thread disposed thereon and a plurality of bendable members projecting outwardly therefrom and at least partially surrounding a receiving space, and wherein at least some of the plurality of bendable members include a retaining ridge projecting toward the receiving space;

a handle tube having an engagement end disposed within the receiving space and a retaining groove circumferentially disposed therein, the retaining ridges projecting into the retaining groove; and a collar having a hole therethrough, the handle tube projecting through the hole, the collar at least partially surrounding the plurality of bendable members, the collar having an internal surface including an internal thread threadedly engaged with the external thread and bending the plurality of bendable members into engagement against the engagement end of the handle tube.

22. The floor care machine according to claim 21 wherein the midhandle member includes a locking tab projecting outwardly from the outer surface, and the collar includes a locking surface frictionally engaged with the locking tab and inhibiting a disengaging movement of the collar.

23. The floor care machine according to claim 22 wherein the locking surface comprises an annular surface disposed on an end surface of the collar.

24. The floor care machine according to claim 22 wherein the collar includes at least one locking bump disposed on the locking surface proximate the locking tab and inhibiting a disengaging movement of the collar.

25. A duct coupling assembly for a floor care machine, comprising:

a first duct having an outer surface with an external thread disposed thereon and a locking tab projecting outwardly therefrom;

a second duct slideably engaged into an end of the first duct;

a flexible seal disposed about the second duct proximate the end of the first duct; and a collar disposed about the second duct and threadedly engaged with the end of the first duct, the collar pressing the seal into an approximately sealing engagement against the second duct and the end of the first duct, and the collar including a locking surface frictionally engaged with the locking tab and inhibiting a disengaging movement of the collar.

26. The coupling assembly of claim 25 wherein the locking surface comprises an annular surface.

27. The coupling assembly of claim 25 wherein the locking surface comprises a first locking surface, the collar further comprising a second locking surface frictionally engaged with the locking tab.

28. The coupling assembly of claim 25 wherein the collar includes at least one locking bump disposed on the locking surface proximate the locking tab and inhibiting a disengaging movement of the collar.

29. A handle coupling assembly for a floor care machine, comprising:

a receiving member having an outer surface with an external thread disposed thereon and a plurality of bendable members projecting outwardly therefrom and at least partially surrounding a receiving space, and wherein at least some of the plurality of bendable members include a retaining ridge projecting toward the receiving space;

a handle tube partially disposed within the receiving space and a retaining groove circumferentially disposed therein, the retaining ridges projecting into the retaining groove; and a collar disposed about the handle tube and threadedly engaged with the external thread, the collar bending the plurality of bendable members into engagement against the handle tube and securing the handle tube into a fixed position.

30. The handle coupling assembly according to claim 29 wherein the receiving member includes a locking tab projecting outwardly from the outer surface, and the collar includes a locking surface frictionally engaged with the locking tab and inhibiting a disengaging movement of the collar.

31. The handle coupling assembly according to claim 30 wherein the locking surface comprises an annular surface disposed on an end surface of the collar.

32. The handle coupling assembly according to claim 30 wherein the collar includes at least one locking bump disposed on the locking surface proximate the locking tab and inhibiting a disengaging movement of the collar.

* * * * *